US012790852B2

(12) United States Patent
Thompson et al.

(10) Patent No.: US 12,790,852 B2
(45) Date of Patent: Nov. 10, 2026

(54) COLLAPSIBLE TENT POLE

(71) Applicant: Big Agnes, Inc., Steamboat Springs, CO (US)

(72) Inventors: Leanne Thompson, Littleton, CO (US); Bryan Davis, Williston, VT (US)

(73) Assignee: Big Agnes, Inc., Steamboat Springs, CO (US)

( * ) Notice: Subject to any disclaimer, the term of this patent is extended or adjusted under 35 U.S.C. 154(b) by 205 days.

(21) Appl. No.: 18/747,224

(22) Filed: Jun. 18, 2024

(65) Prior Publication Data

US 2025/0382821 A1 Dec. 18, 2025

(51) Int. Cl.
*E04H 15/48* (2006.01)
*E04H 15/60* (2006.01)

(52) U.S. Cl.
CPC ..... *E04H 15/60* (2013.01); *E04H 15/48* (2013.01)

(58) Field of Classification Search
CPC .... E04H 15/48; E04H 15/60; A45B 2009/005
USPC ..... 135/74, 114
See application file for complete search history.

(56) References Cited

U.S. PATENT DOCUMENTS 2,379,577 A * 7/1945 Harsted ..... H01Q 1/088 343/900
3,669,133 A * 6/1972 Hyman ..... A45B 9/00 135/74
3,963,037 A 6/1976 Clark
5,029,847 A * 7/1991 Ross ..... A63B 15/00 482/109
7,726,898 B2 6/2010 Lenhart
7,841,353 B2 * 11/2010 Lee ..... A45B 9/00 135/82
8,297,870 B2 10/2012 Lenhart
8,496,019 B2 7/2013 Lenhart et al.
8,776,813 B2 * 7/2014 DeLap ..... E04H 15/60 135/114
9,277,794 B2 3/2016 Moreau
10,660,414 B2 * 5/2020 Lenhart ..... A45B 9/04
11,473,332 B2 * 10/2022 Baranski ..... E04H 15/44
12,553,255 B2 * 2/2026 Furseth ..... E04H 15/46
2002/0117196 A1 * 8/2002 Han ..... E04H 15/60 248/161
2003/0089390 A1 * 5/2003 Seo ..... E04H 15/60 135/120.4

(Continued)

*Primary Examiner* — Robert Canfield
(74) *Attorney, Agent, or Firm* — HOLZER PATEL DRENNAN

(57) ABSTRACT

A segmented tent pole set having a non-elastic cord connecting the pole segments, which allows the segments to be easily assembled to form the pole, always in the correct order. The pole set has pole segments including a first end segment and a second end segment; additional pole segments may be positioned therebetween. The second end segment is sized and shaped to fit over the adjacent pole segment, whether the first end segment or an additional pole segment; that is, the adjacent pole segment is received within the second end segment. A non-elastic cord connects the first end segment and the second end segment. The second end segment includes a push button spring clip and the adjacent pole segment includes a hole for receiving the push button. The pole segments can be expanded and collapsed, with the push button inhibiting collapse and the cord inhibiting overexpansion.

18 Claims, 12 Drawing Sheets

(56) References Cited

U.S. PATENT DOCUMENTS

| | | | | |
|---|---|---|---|---|
| 2011/0304166 | A1 | 12/2011 | Rathmell et al. | |
| 2013/0312797 | A1 | 11/2013 | Lah | |
| 2014/0069475 | A1* | 3/2014 | Lenhart | A45B 9/04 135/74 |
| 2017/0027290 | A1* | 2/2017 | Heim | A45B 9/00 |
| 2021/0106104 | A1 | 4/2021 | Shute et al. | |
| 2021/0388939 | A1* | 12/2021 | Yang | E04H 15/48 |
| 2023/0128362 | A1* | 4/2023 | Hofer | A45B 9/00 135/74 |

* cited by examiner

COLLAPSIBLE TENT POLE

BACKGROUND

Tents and camping equipment come in all different shapes and sizes. With respect to tents, there is often a need for a tent that is easy and fast to erect. To facilitate erection of tents, the support poles commonly have multiple pole segments that are connected by an elastic cord, often referred to as a shock cord, that extends through the interior of the segments. The elastic cord allows the segments to be easily assembled, in the correct order, and disassembled. Additionally, having the segments connected by the elastic cord ensures a segment will not be lost.

On occasion, e.g., with repeated assembly and unassembly of the pole segments, the elastic cord breaks.

SUMMARY

The present disclosure provides a segmented tent pole set having a non-elastic cord connecting the segments, allowing the segments to be easily assembled to form the pole, always in the correct order. The tent pole set includes a push button spring clip or push button mechanism to lock in place the assembled pole segments.

In one particular implementation, this disclosure provides a pole set having multiple pole segments including at least a first end segment and a second end segment. Additional pole segments may be positioned therebetween. The first end segment is sized and shaped to fit at least partially over an adjacent pole segment, whether the adjacent pole segment is the second end segment or an additional pole segment; that is, the adjacent pole segment is at least partially received within the first end segment. A non-elastic cord connects the first end segment and the second end segment, and any additional pole segments therebetween. Any or all of the pole segments can be hollow, so that the non-elastic cord passes through the pole segment. The first end segment includes a push button spring clip and the adjacent pole segment includes an aperture for receiving the push button.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. These and various other features and advantages will be apparent from a reading of the following Detailed Description.

BRIEF DESCRIPTION OF THE DRAWING

The disclosure may be more completely understood in consideration of the following detailed description of various embodiments of the disclosure in connection with the accompanying drawing, in which.

DETAILED DESCRIPTION

Figure 1:
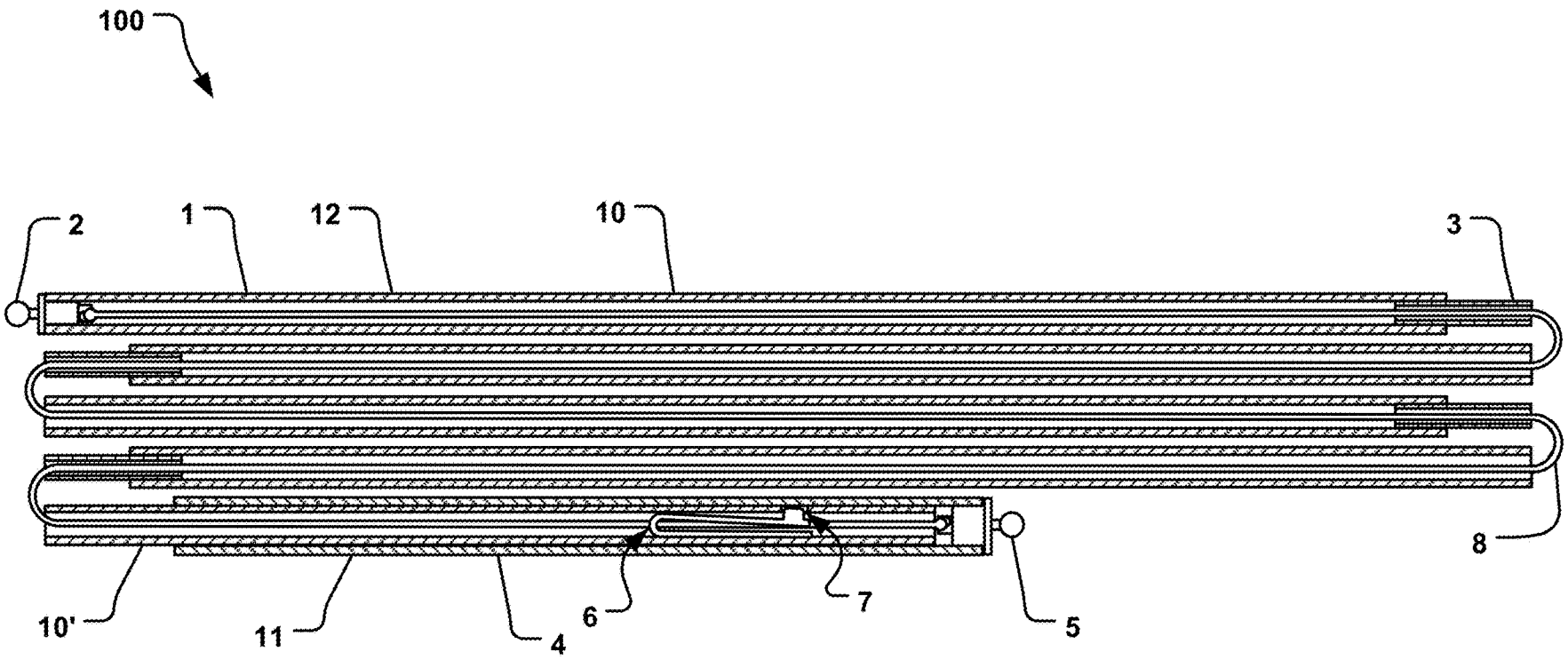
FIG. 1 is a cross sectional view of a collapsed pole set.

Described herein is a pole set, such as for a tent, canopy, or furniture such as a table or chair, the pole set having at least two pole segments. The pole segments, when assembled, form a pole. The pole set has a non-elastic cord connecting the pole segments, typically through a hollow interior of the pole segments. A push button spring clip or mechanism locks the relative position of the pole segments when the pole segments are assembled forming a pole.

In the following description, reference is made to the accompanying drawing that forms a part hereof and in which are shown by way of illustration at least one specific embodiment. In the drawing, like reference numerals are used throughout several figures to refer to similar components. In some instances, a reference numeral may have an associated sub-label consisting of a lower-case letter to denote one of multiple similar components. When reference is made to a reference numeral without specification of a sub-label, the reference is intended to refer to all such multiple similar components.

Referring to FIG. 1, a pole set 100 is shown. The pole set 100, when assembled, forms a pole that can be one of several forming the supporting structure of a collapsible tent or canopy, or even of collapsible furniture such as a table or chair. In FIG. 1, the pole set 100 is shown in a collapsed or folded orientation.

The pole set 100 is composed of multiple hollow pole segments 10, including at least a first end segment 11 and a second end segment 12, and in this set 100, a pole segment 10' that is adjacent to the first end segment 11. This pole set 100 also has three intermediate segments between the pole segment 10' adjacent the first end segment 11 and the second end segment 12.

The second end segment 12 is a regular pole segment 1, as is commonly known. The second end segment 12 may be any length, diameter, and cross-sectional shape. At the end of the second end segment 12 is a pole tip 2, which connects to the end of the second end segment 12. At least a portion of the tip 2 may fit within the second end segment 12. The tip 2 may be securely attached to the end of the second end segment 12, either permanently or removably. A portion of the tip 2 may fit within the segment 12 or the tip 2 may be merely in contact with the end of the segment 12. The pole tip 2 may be any of a variety of shapes, sizes, and materials.

The first end segment 11 is a larger diameter pole segment 4, which fits closely over any regular pole segment 1, so as to slide over it; in FIG. 1, the first end segment 11 slides over the adjacent pole segment 10'. The first end segment 11 may be any length, diameter, and cross-sectional shape, as long as it has a shape and diameter to allow the first end segment 11 to fit over the adjacent pole segment 10', which in some embodiments could be the second end segment 12; typically, the first end segment 11 will have a larger diameter than the adjacent pole segment 10', the regular pole segments 1 and the second end segment 12. In FIG. 1, the first end segment 11 is seen slid over its adjacent pole segment 10'.

At the end of the first end segment 11 is a pole tip 5, which connects to the end of the first end segment 11; at least a portion of the tip 5 may fit within the first end segment 11.

The tip 5 may be securely attached to the end of the first end segment 11, either permanently or removably, or the tip 5 may be merely in contact with the end of the segment 11. The pole tip 5 may be any of a variety of shapes, sizes, and materials.

Positioned between the first end segment 11 and the second end segment 12 may be any number of additional pole segments 10, which can be regular pole segments 1. The additional pole segments 10 may vary in any length, however, at least the one adjacent pole segment 10' adjacent to the first end segment 11 has a diameter less than that of the first end segment 11, so that the first end segment 11 can slide over the adjacent pole segment 10'.

Positioned between adjacent segments 10 (between the first end segment 11, the second end segment 12, and any additional pole segments 10), is a ferrule 3, which is a common connection element for segments. The ferrule 3 at least partially fits into the interior of the pole segments 10. The ferrule 3 may be connected to or integral with one of the pole segments 10 or may be independent.

In this pole set 100, the first end segment 11, the second end segment 12, and any additional pole segments 10 are hollow along their entire length. Extending through the interior of all of the segments 10 is a cord 8. The cord 8 extends between and connects the first end segment 11 to the second end segment 12; in most designs, the cord connects to the tip 2 and to the tip 5. In some embodiments, the cord 8 may extend to only one of the tip 2 or the tip 5. The cord 8 is a non-elastic cord; that is, it is not readily stretchable, as are conventional shock cords. The cord 8 stretches no more than 10% of its length under a force directly applied by a human user, in some embodiments the cord 8 stretches no more than 5% of its length under a force directly applied by a human, and in other embodiments, no more than 3%. Examples of suitable materials for the cord 8 include nylon, polypropylene, wire (metal), and combinations thereof. The cord 8 may be a monofilament, braided, woven, or have any known configuration. The cord 8 can have any of a variety of diameters and cross-sectional shapes, as long as the cord 8 moves freely within the internal hollow length of the pole segments 10.

In some embodiments, the cord 8 is not continuous from the tip 2 to the tip 5. For example, the cord 8 may extend short of the tip 2, terminating within and/or secured to the second end segment 12. As another example, the cord 8 may be noncontinuous through the set of pole segments 10; the cord 8 may be formed of multiple pieces of cord, which may or may not be connected. In some embodiments, an elastic cord may be combined with the non-elastic cord 8. In all embodiments, however, the non-elastic cord 8, having low to no stretch, is present through the ferrules 3 connecting adjacent pole segments 10.

The cord 8, whether a single piece connecting the tip 2 to the tip 5, or multiple pieces, or extending short of the tip(s), is sufficiently long to provide sufficient slack at the ferrules 3 to be able to configure the pole set 100 in the configuration shown in FIG. 1, with the pole segments 10 disconnected and aligned in a parallel manner.

The pole set 100 includes a spring clip 6 having a push button activator. The push button spring clip 6 fits within and is fixed to a regular pole segment 1, in the shown design, in the pole segment 10' adjacent to the first end segment 11. The spring clip 6 can be a variety of shapes, sizes, configurations, and can be made of one or multiple components; the configuration shown in FIG. 1 is merely one example of a spring clip 6.

Figure 2:
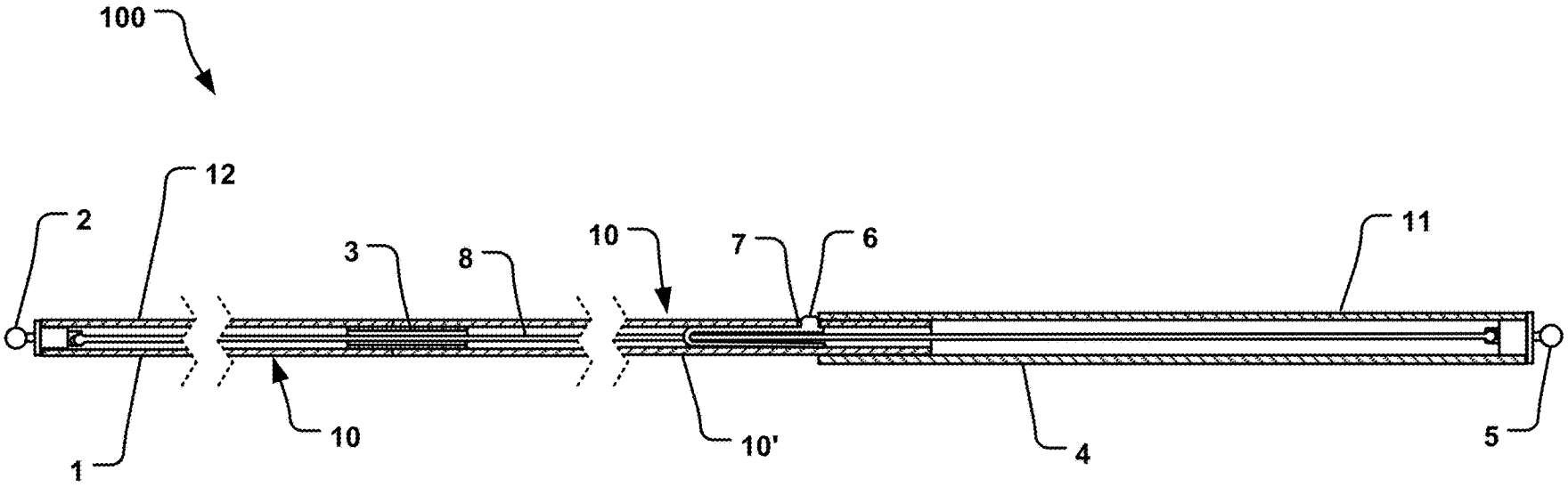
FIG. 2 is a cross sectional view of a portion of the pole set of FIG. 1 assembled.

The push button spring clip 6 is longitudinally fixed in position within the pole segment 10'. The pole segment 10' includes an aperture or hole 7 through the wall of the pole segment 10' through which the push button activator of the spring clip 6 can protrude from the interior of the pole 10' to its exterior. In some embodiments, multiple holes 7 may be present, e.g., longitudinally spaced along a length of the pole segment 10'. The hole 7 or holes 7 are located so that as the first end segment 11 slides off of the adjacent pole segment 10', the push button of the spring clip 6 is able to protrude through the hole 7. FIG. 2 shows the pole set 100 expanded and with the push button of the spring clip 6 protruding through the hole 7 in the wall of the pole segment 10'.

As indicated above, FIG. 2 shows the pole set 100 expanded, with the multiple pole segments 10 longitudinally aligned and connected via the ferrules 3. The cord 8 is seen extending through the internal hollow of the pole segments 10 from the tip 2 to the tip 5. In this orientation of the pole set 100, the cord 8 is stretched taut or tight, with little or no slack. Specifically, a user would not be able to (with a normal or regular force applied by the user) pull any of the segments 10 apart.

Figure 3A:
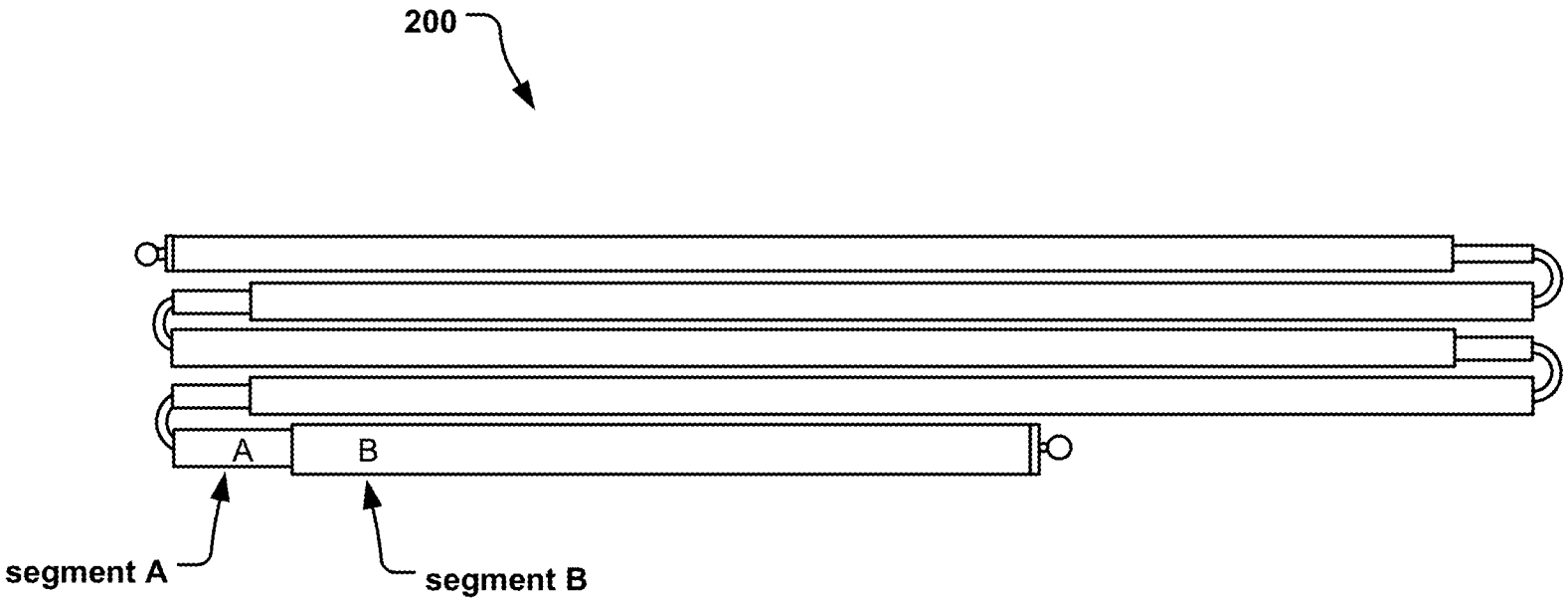
FIG. 3A is a side view of a pole set in a folded configuration.

FIGS. 3A through 3D show, stepwise, the process for expanding a pole set 200 and locking it to its extended position, the pole set 200 similar to the pole set 100 of FIGS. 1 and 2. FIG. 3A shows the pole set 200 in its collapsed or folded position, with the pole segments parallel to each other; it is this position in which the pole set 200 is typically stored when the tent or other structure is not set up. In this collapsed or folded position, the pole set 200 readily fits into a storage bag. In FIG. 3A, a pole segment A and a pole segment B are called out. Pole segment B corresponds to the first end segment 11 of the set 100 and the pole segment A corresponds to the adjacent pole segment 10' having the spring clip therein. As seen in FIG. 3A, segment B is at least partially slid over and covering segment A.

Figure 3B:
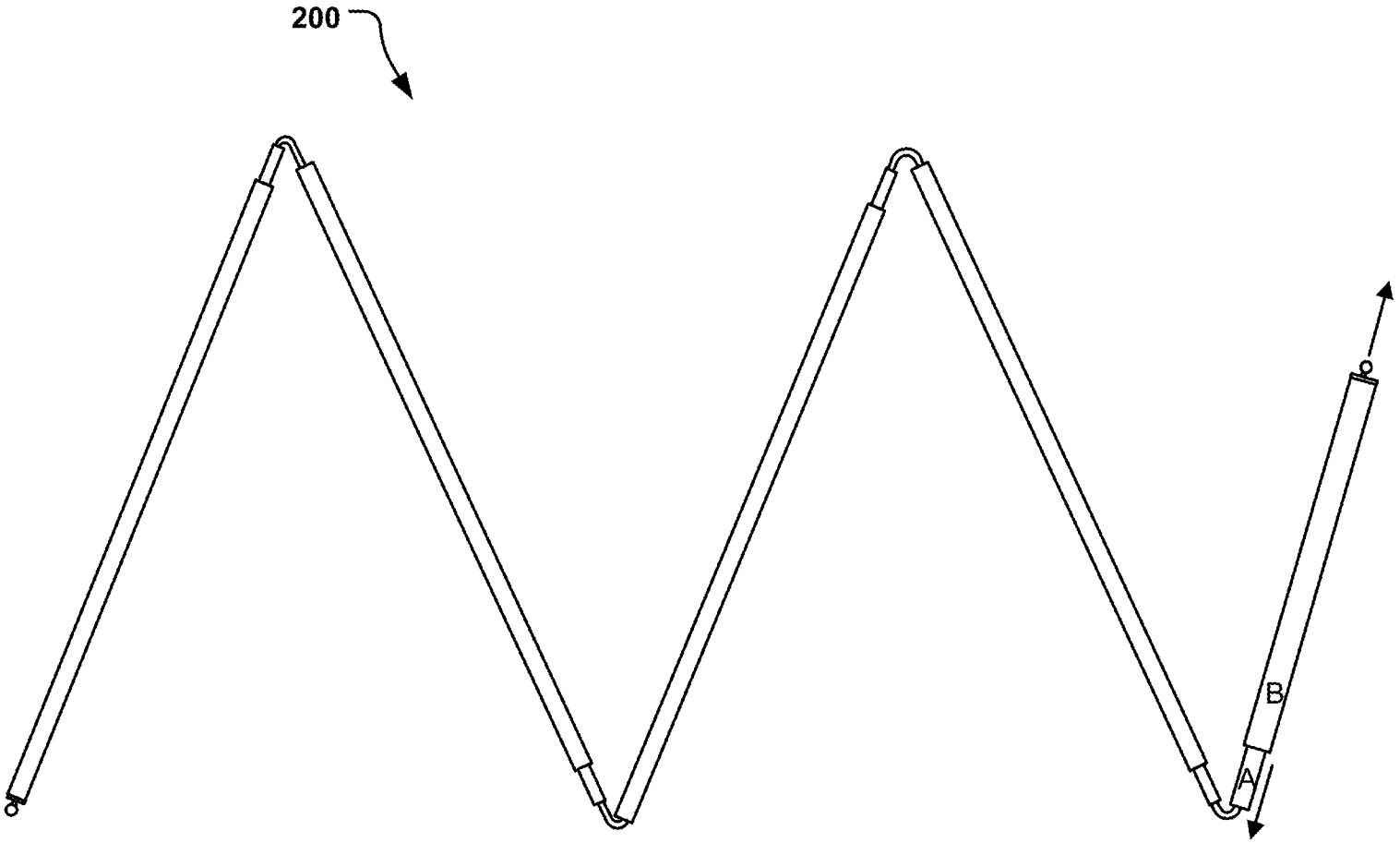
FIG. 3B is a side view of the pole set partially unfolded.

In FIG. 3B, the pole set 200 is shown partially opened or expanded, with the poles segments no longer parallel to each other. At this stage, segment B can be partially pulled off of segment A (or, segment A can be pulled out of segment B).

Figure 3C:
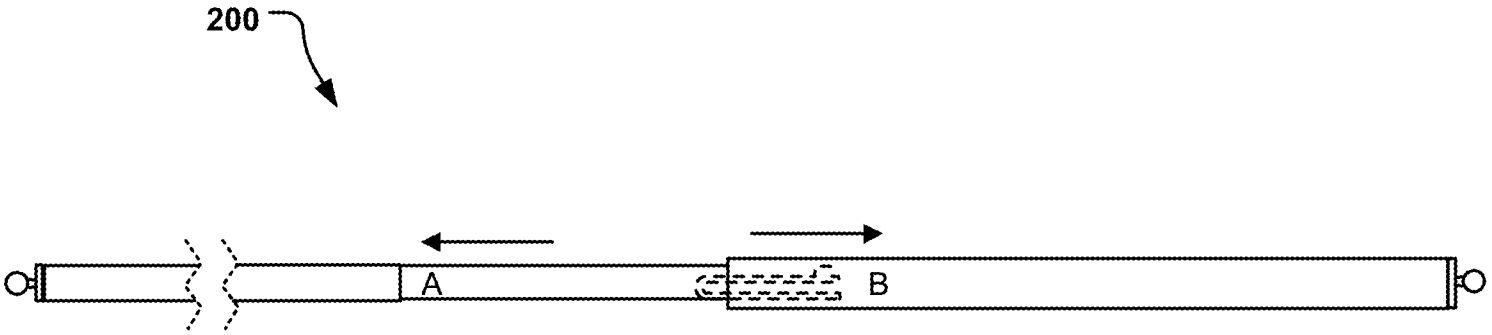
FIG. 3C is a side view of the pole set straightened and partially extended.

In FIG. 3C, the segments are shown aligned, with the ferrules (not seen) connecting adjacent segments. The spring clip is shown in phantom, hidden in the interior volume of segment A. At this stage, the pole set is not fully expanded yet. Additional movement of segment A out of segment B expands the pole set fully.

Figure 3D:
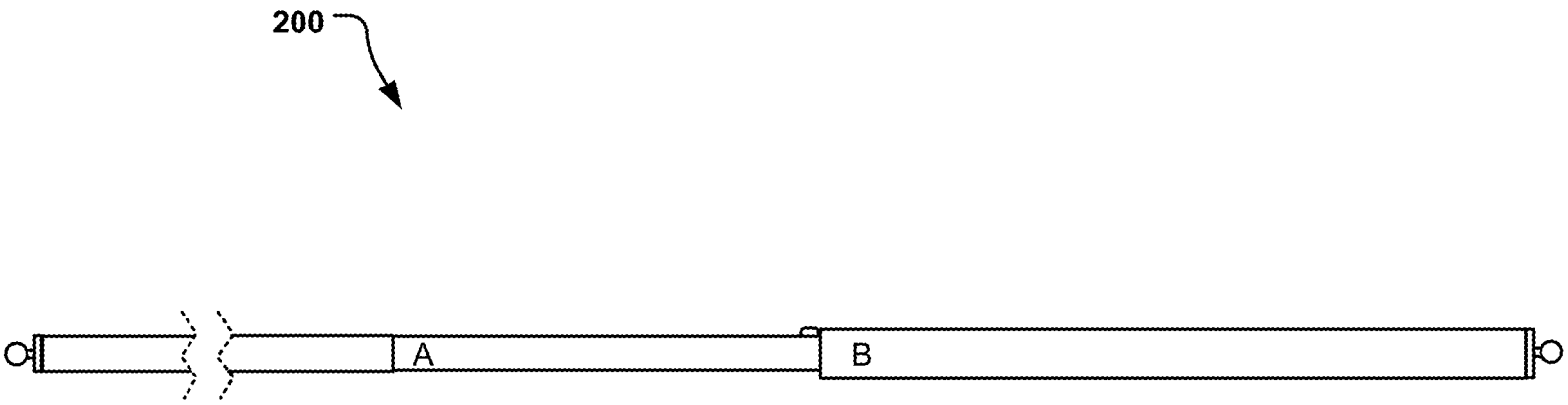
FIG. 3D is a side view of the pole set straightened and fully extended.

FIG. 3D shows the pole set 200 fully expanded, with the push button from the spring clip protruding through the hole in the wall of segment A and abutting the end of segment B. The relative position of segment A to segment B is fixed at this stage, as the push button inhibits segment B from sliding back over segment A and the internal cord inhibits segment B from sliding farther off of segment A.

Thus, example steps for expanding or assembling the pole set are:

1. Take folded pole set (FIG. 3A) and lay out loosely (FIG. 3B).
2. Extend segment A out of segment B (FIG. 3C).
3. The user may need to move or adjust the pole segments and/or ferrules to obtain proper connection.
4. Keep pulling segments A and B apart until the push button of the spring clip pops up through the hole in segment A (FIG. 3D). The user may need to rotate the segments A and B in relation to each other to align the push button with the hole.
5. The assembled pole set may now be used, e.g., attached to a tent.

FIGS. 4A through 4D show, stepwise, the process for collapsing the pole set 200 from its extended position to a folded position.

Figure 4A:
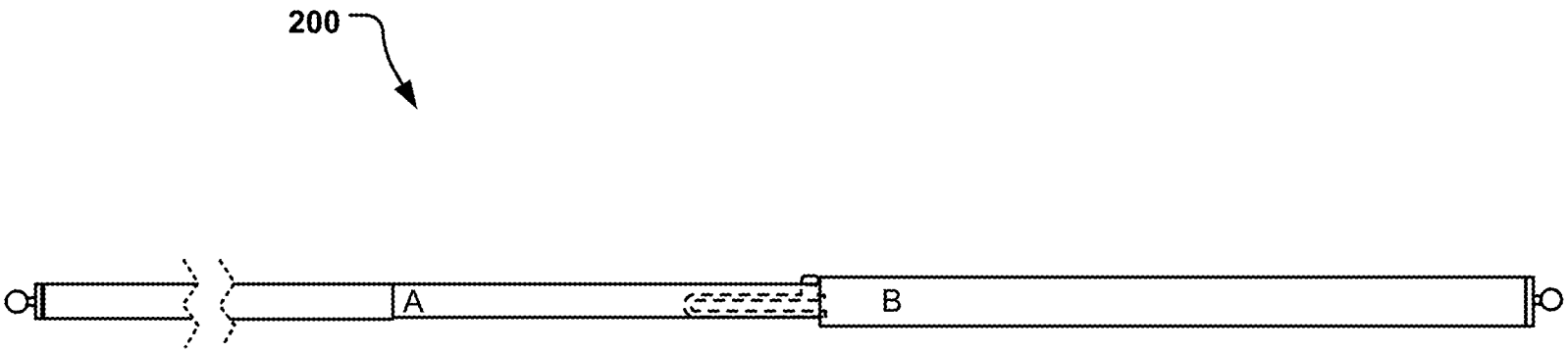
FIG. 4A is a side view of the pole set of FIG. 3D fully extended with a partial internal view.

FIG. 4A shows the pole set 200 in its extended position, as used, e.g., for supporting a tent or other structure. The pole segments are securely connected to each other and cannot be removed from each other while in this configuration without damaging an element, e.g., a pole, a ferrule, the cord, a tip, etc. In this configuration, in FIG. 4A, the push button from the spring clip is protruding through the hole in the wall of segment A and the end of segment B (the end opposite the tip) abuts the push button, fixing the relative position of segment A to segment B, as the push button inhibits segment B from sliding back over segment A and the internal cord inhibits segment B from sliding farther off of segment A.

Figure 4B:
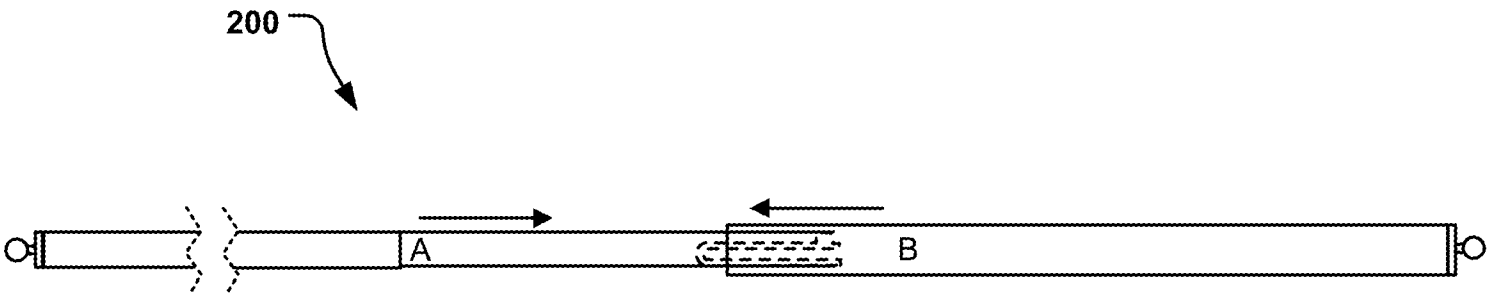
FIG. 4B is a side view of the pole set partially collapsed.

In FIG. 4B, the segments A and B are shown aligned, with the ferrules (not seen) connecting adjacent segments, but with the push button recessed into the interior hollow of segment A, e.g., by the user's finger. In this position, the push button does not affect (e.g., inhibit) the movement of segment B over segment A. The spring clip is shown in phantom, hidden in the interior volume of segment A. At this stage, the pole set 200 has contracted from the fully extended position.

Figure 4C:
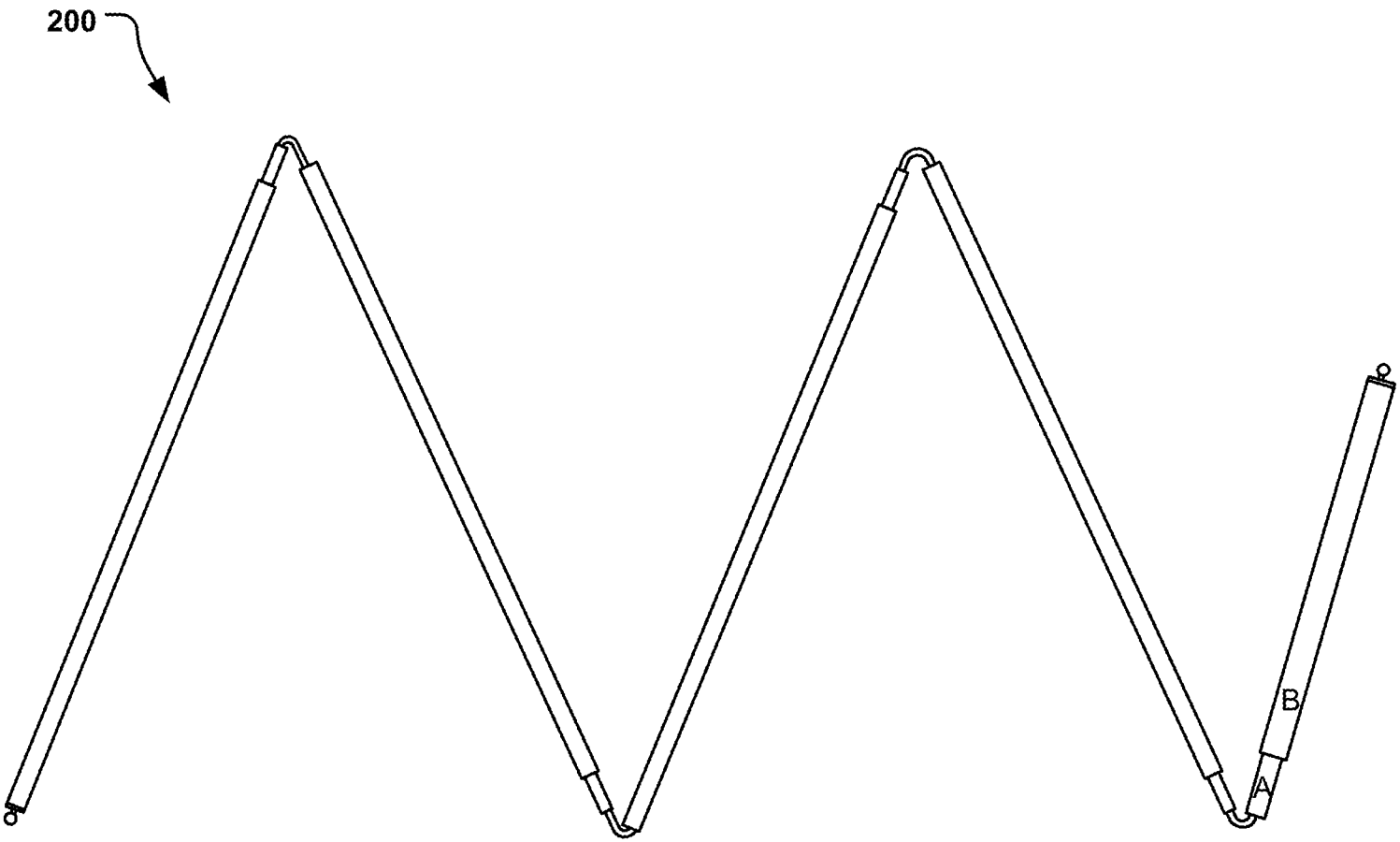
FIG. 4C is a side view of the pole set partially folded.
Figure 4D:
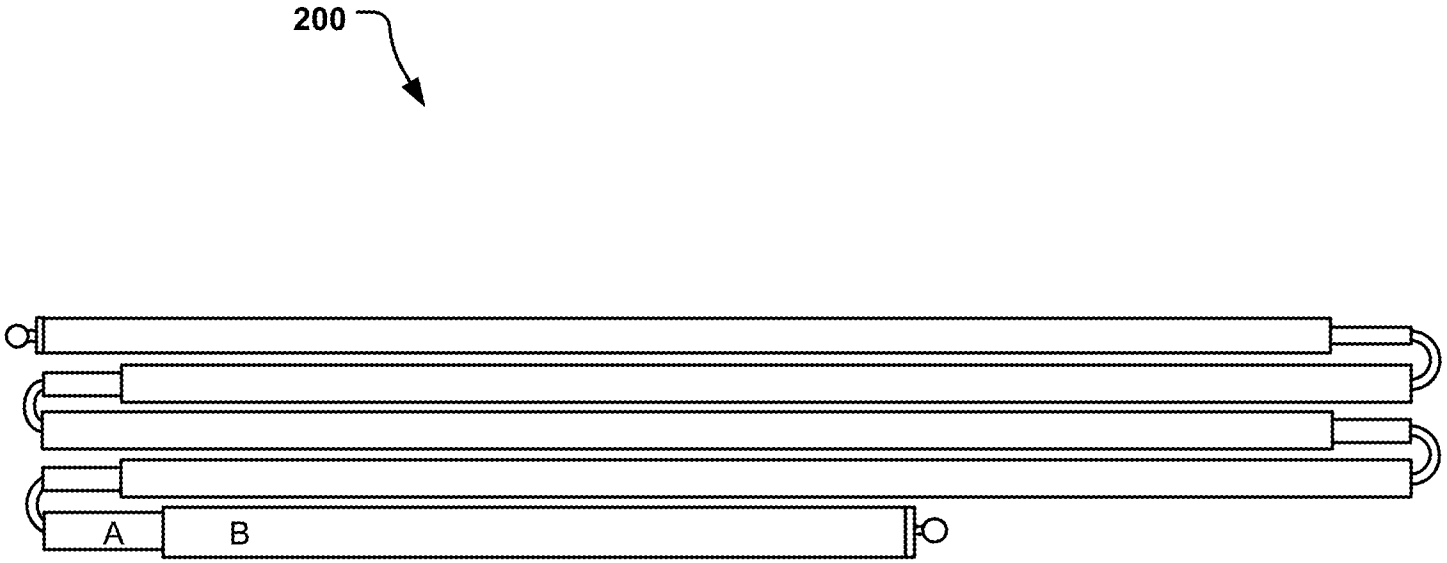
FIG. 4D is a side view of the pole set in a fully folded configuration.

In FIG. 4C, segment B is further slid over segment A, providing slack in the cord and allowing the pole segments to be disconnected at the ferrules. Once disconnected, the pole segments can be folded to be parallel to each other, in the folded position shown in FIG. 4D.

Thus, example steps for folding or disassembling a pole set are:

1. Push the push button down far enough so that the button no longer extends outside of the wall of the segment A, so that the outer segment B can slide over the push button and over segment A.
2. Slide segment B over segment A (in some embodiments, as much as possible).
3. The cord is now loose enough to fold the pole set 200.

The folded pole set 200 can be stored in, e.g., a bag.

Figure 5:
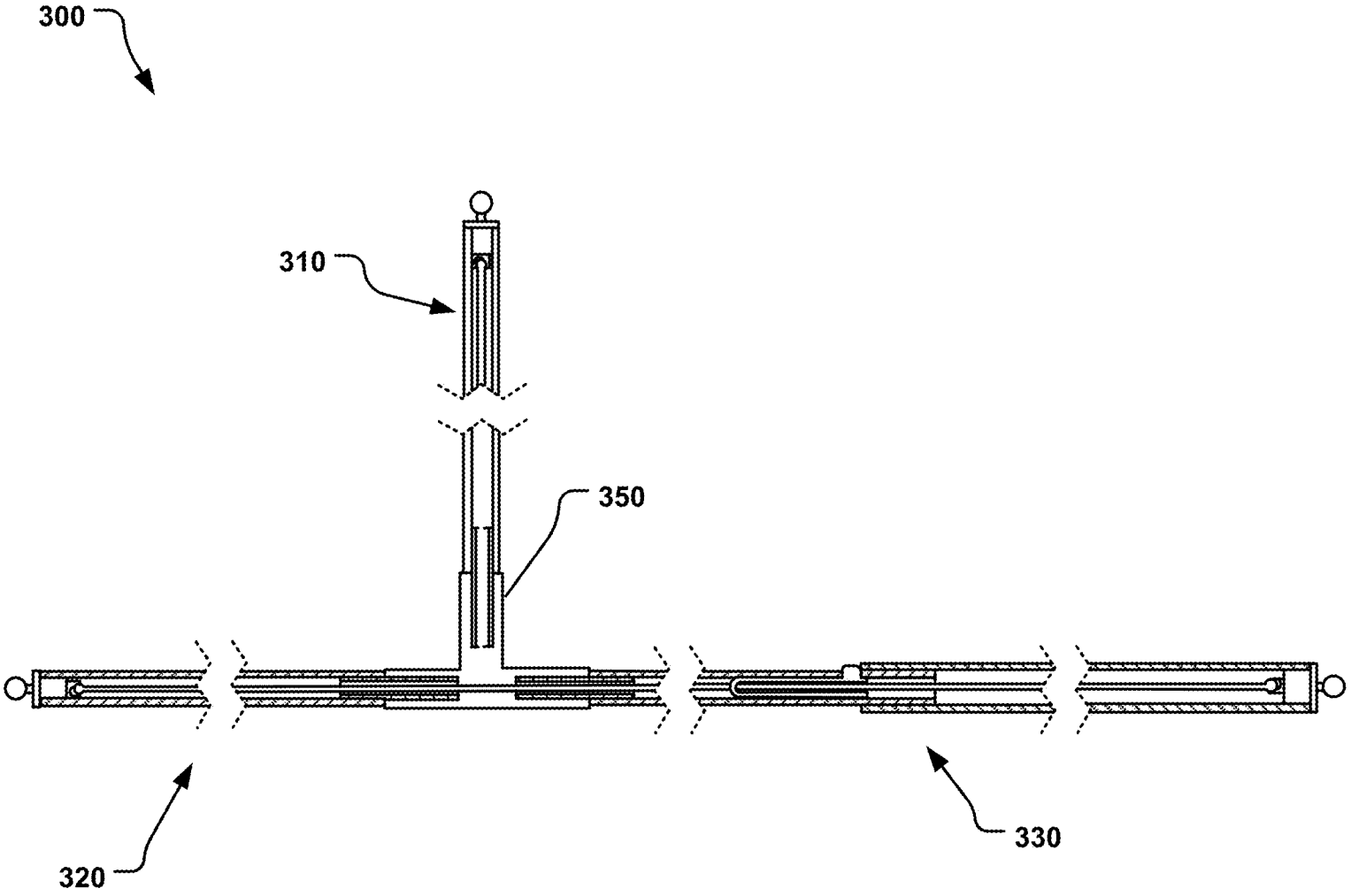
FIG. 5 is a cross sectional side view of another pole set having a pole intersection in the extended configuration.

FIG. 5 shows a pole set 300 having an intersection of three pole subsets 310, 320, 330, each of the subsets having at least one pole segment. The pole subsets 310, 320, 330 meet at a hub 350. In this shown embodiment, each of the subsets 310, 320, 330 has a cord running through the hollow interior, but only one pole subset (in this example subset 330) has a push button spring clip mechanism. In this design, the cord through the subset 330 is connected to the cord in the subset 310 and to the cord in the subset 320, so that tension on the cord in subset 330 also tightens the cord in the subsets 310, 320. The three cords may be joined (e.g., knotted, spliced) at their intersection in the hub 350. In an alternate embodiment, a first cord runs through the subset 310 and the subset 330 and a second cord runs through the subset 320 and the subset 330; thus, the subset 330 has two cords in its hollow interior, with both operably connected to the tip of the subset 330.

As in the pole sets 100, 200 described above, the pole set 300 has a push button spring clip in the subset 330 that locks the relative position of the pole segments in the subset 330, thus applying tension to the cords through all the pole subsets 310, 320, 330.

Figure 6:
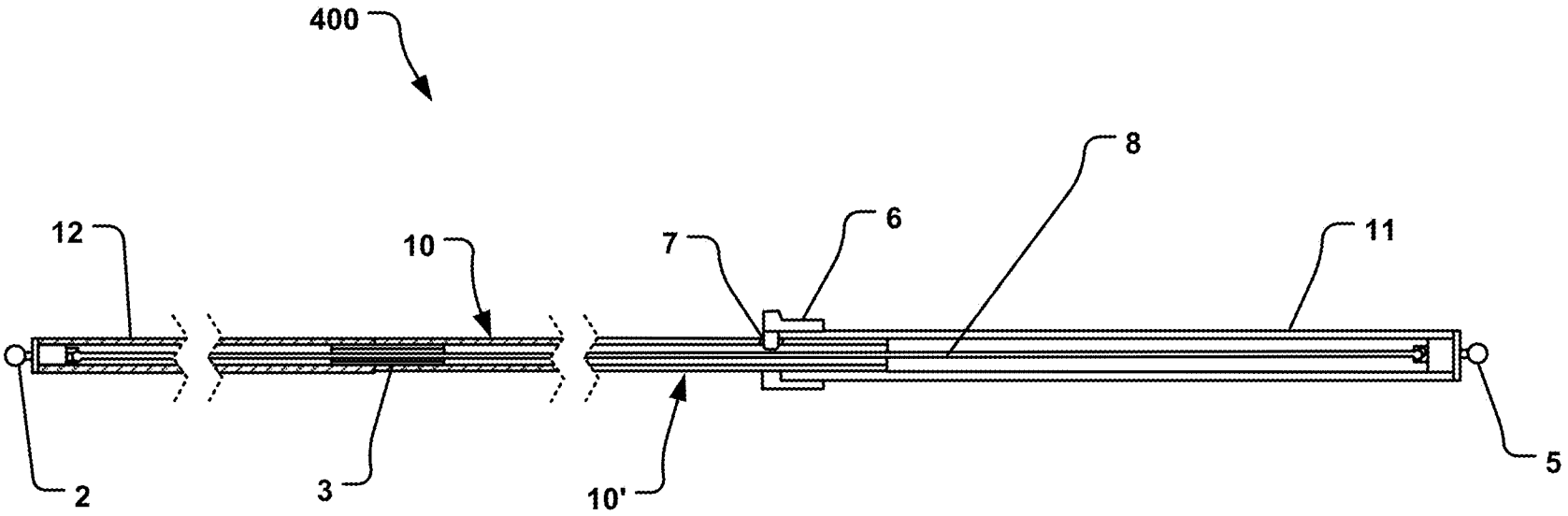
FIG. 6 is a cross sectional side view of an alternate pole set in the extended configuration.

FIG. 6 shows a pole set 400. Similar to the pole set 100 described above, the pole set 400 is composed of multiple hollow pole segments 10, including at least a first end segment 11 and a second end segment 12. It is to be understood that various features and/or details from the pole set 100, described above, may be applied to this pole set 400 unless contrary to the construction.

The second end segment 12 is a regular pole segment 1, of any length, diameter, and cross-sectional shape. At the end of the second end segment 12 is a pole tip 2, which connects to the end of the second end segment 12. At least a portion of the tip 2 may fit within the second end segment 12. The tip 2 may be securely attached to the end of the second end segment 12, either permanently or removably, or the tip 2 may be merely in contact with the end of the second end segment 12. The pole tip 2 may be any of a variety of shapes, sizes, and materials.

The first end segment 11 is a larger diameter pole segment 4, which fits closely over any regular pole segment 1, so as to slide over it. The first end segment 11 may be any length, diameter, and cross-sectional shape, as long as it is shaped and sized to receive an adjacent pole segment therein, which could be the second end segment 12. At the end of the first end segment 11 is a pole tip 5, which connects to the end of the first end segment 11. At least a portion of the tip 5 may fit within the first end segment 11. The tip 5 may be securely attached to the end of the first end segment 11, either permanently or removably, or the tip 5 may be merely in contact with the end of the segment 11. The pole tip 5 may be any of a variety of shapes, sizes, and materials.

Positioned between the first end segment 11 and the second end segment 12 may be any number of additional pole segments 10, which can be regular pole segments 1. The additional pole segments 10 may vary in any length, however, at least the one pole segment 10' adjacent to the second end segment 12 has a diameter less than that of the first end segment 11, so that the first end segment 11 can slide over the adjacent pole segment 10'.

Positioned between adjacent segments 10 (between the first end segment 11, the second end segment 12, and any additional pole segments 10), is a ferrule 3, which at least partially fits into the hollow interior of the pole segments 10.

Extending through the interior of all of the segments 10 is a cord 8; the cord 8 extends between and connects the first end segment 11 to the second end segment 12. The cord 8 is a non-elastic cord, that is, it is not readily stretchable, as are conventional shock cords. The cord 8 stretches no more than 10% of its length under a force directly applied by a human user, in some embodiments, the cord 8 stretches no more than 5% and even no more than 3% of its length under a force directly applied by a human. Examples of suitable materials for the cord 8 include nylon, polypropylene, wire (metal), and combinations thereof.

The cord 8 is sufficiently long to provide sufficient slack at the ferrules 3 to be able to provide the pole set 400 in a folded position, with the pole segments 10 disconnected and aligned in a parallel manner (e.g., as in FIG. 1).

The pole set 400 includes a spring clip 6 having a push button activator. The push button spring clip 6 sits around and is fixed to the pole segment 10' adjacent to the first end segment 11. The spring clip 6 can be a variety of shapes, sizes, configurations, and can be made of one or multiple components. The particular push button spring clip 6 of the pole set 400 is affixed to the exterior of the first end segment 11 and is positioned so that the push button extends radially inward beyond the end of the first end segment 11; that is, the push button hangs over the end of the pole segment 11.

The pole segment 10' includes a hole through the wall of the pole segment 10' through which the push button of the spring clip 6 can protrude from the exterior of the pole segment 10' into its interior. In some embodiments, multiple holes may be present, e.g., longitudinally spaced along a length of the pole segment 10'. The hole(s) are located so that as the first end segment 11 slides off of the adjacent pole segment 10', the push button of the spring clip 6 is able to protrude through the hole. FIG. 6 shows the pole set 400 expanded and with the push button of the spring clip 6 protruding through the hole in the wall of the pole segment 10.

The above specification and examples provide a complete description of the structure and use of exemplary implementations of the invention. The above description provides specific implementations and embodiments. It is to be understood that other implementations and embodiments are contemplated and may be made without departing from the scope or spirit of the present disclosure. Features and elements of one implementation may be mixed and matched with features and elements from another implementation unless to the contrary. The above detailed description, therefore, is not to be taken in a limiting sense. While the present disclosure is not so limited, an appreciation of various aspects of the disclosure will be gained through a discussion of the examples provided.

Unless otherwise indicated, all numbers expressing feature sizes, amounts, and physical properties are to be understood as being modified by the term "about," whether or not the term "about" is immediately present. Accordingly, unless indicated to the contrary, the numerical parameters set forth are approximations that can vary depending upon the desired properties sought to be obtained by those skilled in the art utilizing the teachings disclosed herein.

As used herein, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower", "upper", "beneath", "below", "bottom", "above", "on top", "top", etc., if used herein, are utilized for case of description to describe spatial relationships of an element(s) to another. Such spatially related terms encompass different orientations of the device in addition to the particular orientations depicted in the figures and described herein. For example, if a structure depicted in the figures is turned over or flipped over, portions previously described as below or beneath other elements would then be above or over those other elements.

Since many embodiments of the invention can be made without departing from the spirit and scope of the invention, the invention resides in the claims hereinafter appended. Furthermore, structural features of the different embodiments may be combined in yet another embodiment without departing from the recited claims.

The invention claimed is:

1. A pole set comprising:

a first end segment at least partially hollow and an adjacent pole segment, the first end segment sized and shaped to at least partially fit over the adjacent pole segment;

a non-elastic cord connecting the first end segment and the adjacent pole segment; and a push button spring clip fixedly connected to the first end segment, with the adjacent pole segment having a hole for receiving the push button.

2. The pole set of claim 1, wherein the push button spring clip is within the first end segment.

3. The pole set of claim 1, wherein the push button spring clip is on an exterior of the first end segment.

4. The pole set of claim 1, wherein the first end segment is hollow along its length.

5. The pole set of claim 1, wherein both the first end segment and the adjacent pole segment are hollow along their length.

6. The pole set of claim 1 further comprising:

a second end segment;

at least one additional pole segment; and the non-elastic cord present through the first end segment, the adjacent pole segment, the at least one additional pole segment, and the second end segment.

7. The pole set of claim 6, further comprising a first tip present at an end of the first end segment and a second tip present at an end of the second end segment, the non-elastic cord connected to the first tip and the second tip.

8. A pole set comprising:

a plurality of hollow pole segments including a first end segment and a second end segment, the first end segment is sized and shaped to at least partially fit over an adjacent pole segment;

a non-elastic cord connecting the first end segment and the second end segment; and a push button spring clip fixedly connected to the first end segment, with the adjacent pole segment having a hole for receiving the push button.

9. The pole set of claim 8, wherein the adjacent pole segment is the second end segment.

10. The pole set of claim 8, wherein the push button spring clip is within the first end segment.

11. The pole set of claim 8, wherein the push button spring clip is on an exterior of the first end segment.

12. The pole set of claim 8, wherein the cord extends from the first end segment to the second end segment through the hollow pole segments.

13. The pole set of claim 8, wherein the first end segment has a first tip and the second end segment has a second tip, and the cord extends from the first tip to the second tip.

14. The pole set of claim 8, wherein the push button extends through the hole.

15. A pole set comprising:

a first pole segment at least partially hollow and an adjacent pole segment, the first pole segment sized and shaped to at least partially fit over the adjacent pole segment;

a non-elastic cord connecting the first pole segment and the adjacent pole segment; and a push button spring clip fixedly connected to the first pole segment, with the adjacent pole segment having a hole for receiving the push button.

16. The pole set of claim 15, wherein the push button spring clip is within the first pole segment.

17. The pole set of claim 15, wherein the push button spring clip is on an exterior of the first pole segment.

18. The pole set of claim 15, wherein the first pole segment is an end segment.

* * * * *